United States Patent [19]

Gnaga

[11] 4,148,330

[45] Apr. 10, 1979

[54] MOTOR-CURLER UNIT FOR AUTOMATIC APPLICATION OF CURLERS TO THE HAIR TO BE TREATED

[76] Inventor: Vittorio Gnaga, Milan, Italy

[21] Appl. No.: 875,908

[22] Filed: Feb. 7, 1978

[30] Foreign Application Priority Data

Feb. 9, 1977 [IT] Italy ..... 20114 A/77

[51] Int. Cl.[2] ..... A45D 2/12

[52] U.S. Cl. ..... 132/34 C; 132/40

[58] Field of Search ..... 132/34, 42, 40, 39, 132/9

[56] References Cited

U.S. PATENT DOCUMENTS

| | | | |
|---|---|---|---|
| 2,586,103 | 2/1952 | Smith | 132/34 R |
| 2,608,977 | 9/1952 | Trippler | 132/40 |
| 3,026,883 | 3/1962 | Harmon | 132/40 |
| 3,213,860 | 10/1965 | Mizell et al. | 132/34 R |
| 3,376,875 | 4/1968 | Rosan | 132/34 R |
| 3,463,169 | 8/1969 | Zaidan | 132/34 R |
| 3,605,762 | 9/1971 | Fromman | 132/9 |
| 3,939,852 | 2/1976 | Waite | 132/40 |

*Primary Examiner*—G. E. McNeil

*Attorney, Agent, or Firm*—Wenderoth, Lind & Ponack

[57] ABSTRACT

A motor-curler unit for the automatic application of curlers to hair to be treated includes a motor and a curler made of a suitable material, for example a pressed plastic material. The curler includes two coaxial elements which are mated to one another and are adapted for engagement with a corresponding part of the motor in such a manner that a first curler element can be fixed with respect to the motor casing, while a second curler element torsionally joins the relative motor shaft such that by operating the motor, rotation of the second element, rotating respective to the first element, winds the hair around the first element. Thereafter, when the motor is stopped and the curler released, the curler will rest in the hair with the hair lock still wound around it.

14 Claims, 7 Drawing Figures

MOTOR-CURLER UNIT FOR AUTOMATIC APPLICATION OF CURLERS TO THE HAIR TO BE TREATED

This invention relates to a motor-curler unit for automatic application of curlers to the hair to be treated.

It is well known that for dressing washed and still wet hair, the so-called curlers, i.e. small cylinders made of all kinds of materials, are manually applied by winding a hair lock around the same and then fixed near the cutis or the hair root, by means of pins or clips. Subsequently, the hair gets dried by using in general hot-air hairdriers.

The hair winding operation must be performed with a certain skillfulness and attention as to avoid different strains of each hair forming a hair lock. Furthermore, the hair tips which tend to slip off due to their different length, have to be gathered, and obviously, such operation requires a certain attention and time, so if it has been done in a hurry and without the necessary care, the imperfections will be realized once the hair is dried.

Accordingly, it is a principal object of the discovery of this invention to eliminate the above-described drawbacks which are proper to the manual hair curling effected with curlers, while it allows a satifactory curly formation, practically independent on operator's skill and attention as well as remarkable time saving. The invention consists of a motor-curler unit intended for automatic application of curlers to the hair under treatment, characterized in that it comprises a motor and a composed hair-curler made of a suitable material, viz. pressed plastic material, substantially formed of two coaxial elements which are mating one another and are adapted for engagement with a corresponding part of said motor in such a manner that one of the curler elements can be fixed respective to the motor casing, while the other element torsionally joins the relative motor shaft in order that, after having placed the hair lock to be curled on the curler, and by operating said motor, rotation of the congruent element, rotating respective to said stationary element is obtained and thereby winding of the hair lock under treatment around said latter element, and thereafter, when the motor is stopped and the curler released, said latter will rest in the hair with the hair lock still wound around it.

The fundamental of the invention just now disclosed may be adapted for the most various embodiments, both as regards the structure of the composed curler as well as the design of the motor, especially in the mating part for fitting the curler, all those embodiments are within the scope of the discovery when use is made of above-defined inventive fundamental.

According to a preferred embodiment of the invention, the rotating element of the curler which can be coupled with the motor shaft, is outside of the element to be fixed to the relative motor casing part; said rotating element consists of a cylindrical bottom presenting a central prismatic aperture for engagement with the motor shaft, a radial appendix deriving from the periphery of said bottom, wherefrom extends an axially slotted, preferably elastic, cylindrical wall; said bottom presents a suitable seat for fitting therein a corresponding base collar of the internal fixable curler element which assumes a hollow cylindrical structure and said elastic cylindrical wall encircling said rotating element; the opposite base of said internal element presents locking means for torsionally locking said element to the corresponding motor casing part, whereby, between said elastic cylindrical wall of the rotating element and the cylindrical wall of the stationary element, a hollow space is provided, wherein the hair lock gets arranged which is wound around the stationary element by means of said rotating element.

For obtaining engagement of the composed curler with the driving motor the corresponding casing front part, wherein the curler engages, is formed by an appropriately structurized dome-shaped housing, preferbly detachable respective to the remaining casing part, said dome-shaped housing presents a circular front aperture for therein introducing the curler, as well as a shaped slot derived from said aperture for inserting the hair lock to be curled which is picked up by the external rotating element and wound around the internal stationary element of the curler during rotation of said motor shaft; fixing of said internal element is performed by engagement of a tangential rod derived from the external base of said element with a notch or the like provided on said shaped slot, in a suitable position of said dome-shaped housing, whereby said rod-notch engagement is secured by operating a suitable hook rotating around a pin provided radially outside of said dome-shaped housing.

These and other features of the invention will now be explained in the following description with reference to the annexed drawings, while description and drawings are only indicative and not limitative to the protective range of this invention.

In the drawings

Figure 1:
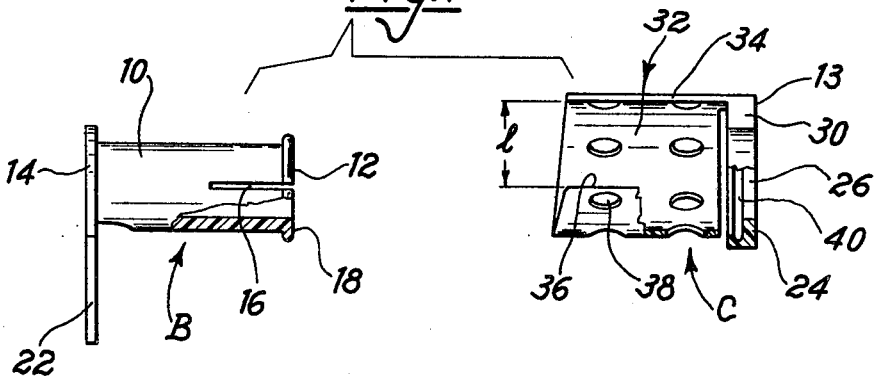
FIG. 1 is a partially sectional side view of the two elements forming the patented composed hair curler which are separately shown.
Figure 2:
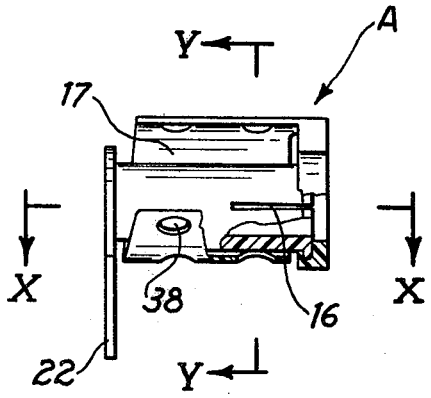
FIG. 2 is a partially sectional side view of the two elements of FIG. 1, in engagement with one another to form the patented hair curler.
Figure 3:
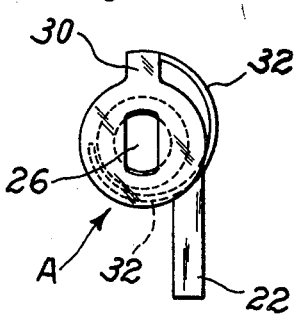
FIG. 3 is a rear view of the patented hair curler.
Figure 4:
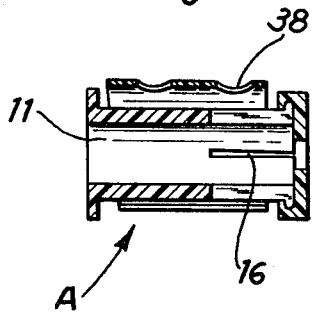
FIG. 4 is a longitudinal section of the hair curler, taken along plane X—X in FIG. 2.
Figure 5:
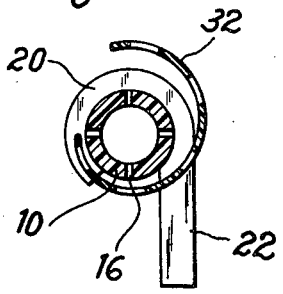
FIG. 5 is a cross-section of the hair curler, taken along plane Y—Y in FIG. 2.

Referring now to the drawings, at first to FIGS. 1 to 5, there may be seen the component of the invention comprising the composed curler A formed by the combination of two elements, substantially coaxial, the internal one B and the external one C, said elements are appropriately structurized, in the present case they are made of pressed plastic material, for example polythene.

The internal element B forming the second component of the invention and which can be fixed to a relative part D of motor F, presents a hollow cylinder 10 of a suitable diameter and length, and an internal base 12 and an external base 14; the proper elasticity of said cylinder 10 is increased towards base 12 by providing axial slots 16. Said base 12 presents a projecting circular rim 18 extending over the whole periphery thereof, while base 14 presents a rim 20 with a larger diameter than that of rim 18, wherefrom a tangential rod 22 is derived for the purpose hereinafter described.

The external rotating element C presents a circular bottom 24 of a suitably larger diameter than that of cylinder 10 and is provided with a central prismatic aperture 26 for torsionally coupling the prismatic shaft 28 of motor F. A radial appendix 30 is derived from bottom 24 having the same thickness as on said bottom, wherefrom at turn a cylindrical wall 32 is derived showing an initial axial edge 34 in correspondence with appendix 30 and the end axial edge 36 appropriately spaced from said edge 34 as to provide between said two edges an axial passageway of width 1. The wall 32 presents a convenient elasticity by being completely separated from bottom 24, except for the isthmus connecting the same to appendix 30; said wall 32 has a certain eccentricity respective to the axis of cylinder 10, and therefore to motor shaft 28. As may be seen, the elastic wall 32 assuming a volute-like course, presents a plurality of perforations 38 in order to lighten element C and consequently hair curler A as well as to facilitate winding operation of the hair lock.

For connecting both elements B–C to form hair curler A, just insert element B into element C and then, by utilizing the elasticity of cylinder 10, the projecting circular rim 18 is introduced into groove 40 of bottom 24 of said element C in order to snap in said groove and to rest lodged therein for permitting reciprocal rotation of elements B–C. In such manner, connection between two elements B–C and therewith the formation of hair curler A is attained.

Figure 6:
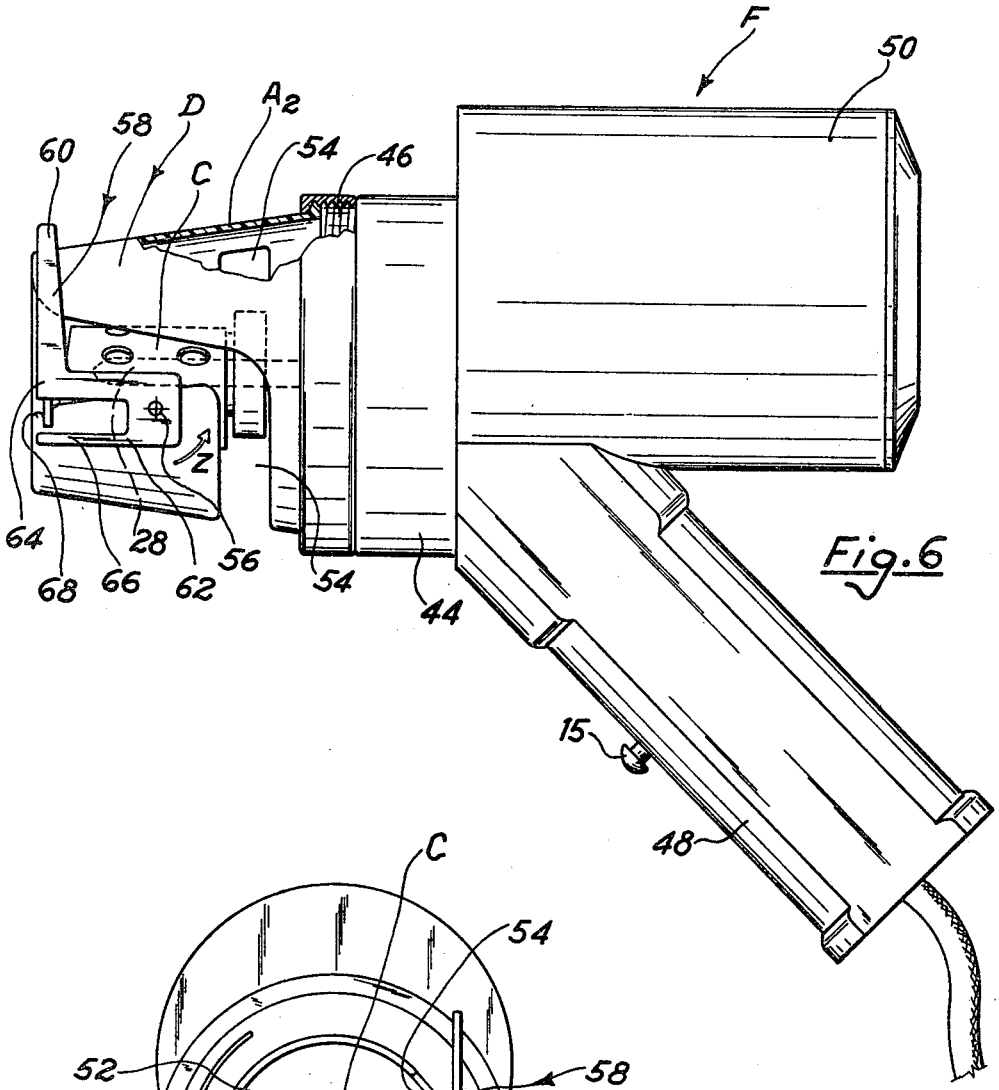
FIG. 6 is a side view of the patented unit; and finally
Figure 7:
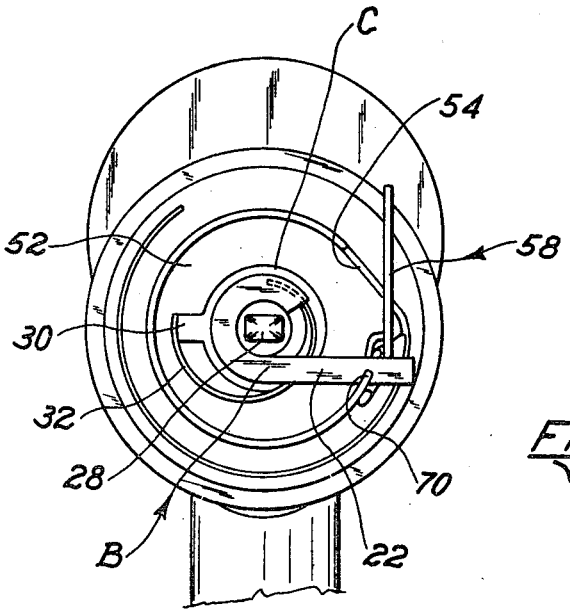
FIG. 7 is a front view of the unit in FIG. 6.

Referring to FIGS. 6 and 7, it can be seen that portion D of motor casing F consists of a conical dome-shaped housing 42 the taper thereof being directed towards the outside; said housing can be secured respective to the crown 44 of the shaped motor casing by means of a threaded ring nut 46. The structure of casing F is so foreseen as to give a handle 48 for the operator which terminates in the cylindrical casing 50 containing the electromotor, the driving shaft thereof transferring the proper rotation to shaft 28 through an adapted revolution reduction gear, whereby shaft 28 being offset respective to the driving shaft. As may be seen, shaft 28 presents a prismatic cross-section in order to allow torsional coupling with the prismatic aperture 26 in bottom 24 of element C. The configuration of component F recalls that of a hairdrier apparatus.

Casing 42, secured to the component F housing, presents a characteristic design, and in particular a substantially circular front opening 52, wherefrom an axial slot 54 of a ragged coruse is derived for the purpose as hereinafter detailed.

The conical wall of casing 42 is provided with a radial pin 56, arranged near the edge of the first portion of slot 54, for engaging L-shaped hook 58 showing a handling branch 60 and a coupling branch 62, divided by two arm 64–66; the edge 68 of slot 54 presents on its front side, near the opening 52, a notch 70 for the purpose as hereinafter described and said notch being provided in correspondence with the relative part of hook 58.

After what disclosed hereinbefore, the use and advantages of the unit A–F are being obvious and may be summarized in the following.

With the motor off, operator will insert hair curler A into the cavity of housing D in such a way that bottom 24 is inside and rod 22 outside thereof; the insertion being effected in order that the prismatic shaft 28 engages with aperture 26 of element C, whereby freely passing through cavity 11 provided in cylinder 10 of element B. Axial positioning of hair curler A within housing D is correctly determined insofar as at insertion completed the surface 13 of bottom 24 will face the respective base surface of the housing cavity, while rod 22 will have reached notch 70 by then. Now, rod 22 is rotated and inserted into notch 70 (FIG. 7), while hook 58 is rotated around pin 56 according to arrow Z, thus, arm 64 of the hook will compress rod 22 for maintaining the same in position in that zone, within notch 70. In this way, correct positioning of hair curler A respective to component F is attained, and thereby operation of the unit patented as having reached the locking condition of internal element B of the hair curler with respect to external element C which is engaged with rotating shaft 28.

Now, a normally dense hair lock is brought in the mouth portion of housing D (respective zone of slot 54), in order to have said hair lock arranged betwen the dome-shaped housing D surface and the external surface of wall 32 of element C, respectively. Then, pushbutton 15 of the apparatus is to be pressed for a period for example of about 3 seconds, while the hair lock will be undergone a rotating action of element C, thereby causing insertion of said hair lock in the hollow space 17 between the two elements B–C, so as to be wound around element B which - as already described - does not move within the dome-shaped casing D due to the engagement (connection) of rod 22 within notch 68, locked by lever 58.

Once pressure on pushbutton 15 has been released, the motor stops as well as shaft 28 together with element C. The operator now turns lever 58 around pin 56 in opposite direction of arrow Z, and as a consequence thereof, arm 66 of lever 58 will release rod 22 from notch 68. The unit A–F will now come off from the hair, while curler A, around which the hair lock is still wound, rests in position when coming out from the dome-shaped casing D. When the hair is dried, curler A will be taken to its two pieces B–C, whereby the hair lock becomes free which will result conveniently curled.

It is to be understood that all operations of application, winding and separation of the curler by the patented assembly are completely imperceptable for the person under treatment who, after the different applications of various curlers and their removal, will show a perfectly performed dressing, obtained in less time than normally employed for manual application of the curlers and more resistant than hair dressings prepared according to already known technics.

The automatic winding performance of the hair by the assembly A–F is, therefore, perfect and uniform for all the hair of each hair lock; their tips are always curled without any exception. In case it is desirable, the automatic winding procedure of the hair lock is effected closer to the cutis than usually: this because automatic winding is started at the hair root towards the tip and not vice versa as it occurs when using the prior art curlers. As already indicated, the time employed is much less than that required for manual operations, i.e. about a third of the time necessary for manual operations.

Due to the automaticity of the operations, these can be perfectly executed not only by a skilled hairdresser, but also by an assistant.

The hair drying process is quicker because winding of the hair locks is always accompanied by a dripping and squeezing action, and thus the locks loose most of the water contained therein during winding.

In practice, the particulars of accomplishment and realization may anyhow vary, without therefore departing from the scope of the present discovery and the domain of the patent.

I claim:

1. A motor-curler assembly for automatically curling locks of hair, said assembly comprising:

a motor unit including a rotatable shaft and a nonrotatable housing; and a composite curler unit adapted to be selectively assembled to and disassembled from said motor unit, said curler unit comprising an outer rotatable curler, means for selectively attaching said outer curler to said shaft for rotation therewith, an inner stationary curler selectively positionable substantially coaxially within said outer curler with a substantially annular space therebetween, means for axially fixing said inner curler within said outer curler while allowing relative rotation therebetween, means for allowing a lock of hair to be curled to be inserted into said substantially annular space, and means for selectively fixing said inner curler to said housing, whereby upon rotation of said shaft and said outer curler, said inner curler will be prevented from rotation, and a lock of hair inserted into said annular space will be wound therein around said inner curler by rotation of said outer curler.

2. An assembly as claimed in claim 1, wherein said outer curler comprises a circular end, a radial projection extending outwardly from the periphery of said circular end, and a partially circumferential substantially cylindrical wall connected to said radial projection and extending axially of said circular wall.

3. An assembly as claimed in claim 2, wherein said shaft has a noncircular cross-sectional shape, and said means for attaching said outer curler to said shaft comprises a noncircular aperture extending through said circular end, said noncircular aperture being complementary in configuration to said noncircular shape of said shaft.

4. An assembly as claimed in claim 2, wherein said cylindrical wall of said outer curler is flexible and is free of connection to said circular end except at said radial projection.

5. An assembly as claimed in claim 4, wherein said means for allowing a lock of hair to be inserted into said annular space comprises an axial passageway in said cylindrical wall, extending throughout the entire axial length thereof.

6. An assembly as claimed in claim 2, wherein said cylindrical wall has perforations therein.

7. An assembly as claimed in claim 2, wherein said inner curler comprises a hollow cylinder having first and second annular rims extending outwardly around the peripheries of first and second opposite ends thereof, respectively.

8. An assembly as claimed in claim 7, wherein said axial fixing means comprises an annular groove in said circular end of said outer curler, said first annular rim of said inner curler adapted to fit within said annular groove.

9. An assembly as claimed in claim 8, wherein said hollow cylinder of said inner curler has therein axial slots extending from said first end thereof.

10. An assembly as claimed in claim 7, wherein said means for fixing said inner curler to said housing comprises a notch in said housing, and a rod extending outwardly from said second annular rim, said rod being selectively positionable within said notch.

11. An assembly as claimed in claim 10, wherein said rod extends tangentially from said second annular rim.

12. An assembly as claimed in claim 10, further comprising means for selectively retaining said rod within said notch.

13. An assembly as claimed in claim 12, wherein said retaining means comprises a hook member pivotally connected to said housing, said hook member including a first arm positioned to contact said rod and retain said rod within said notch upon pivoting movement of said hook member in a first direction, and said hook member including a second arm positioned to contact said rod and remove said rod from said notch upon pivoting movement of said hook member in a second direction.

14. An assembly as claimed in claim 1, wherein said housing includes a dome-shaped portion having a forward aperture for the introduction and removal of said curler unit, and a slot extending from said forward aperture for the introduction of a lock of hair to be curled.

* * * * *